United States Patent [19]

Fick, Jr.

[11] Patent Number: 4,494,465

[45] Date of Patent: Jan. 22, 1985

[54] TABLE FOR USE WITH AUTOMOBILE TRUNKS AND THE LIKE

[76] Inventor: Charles M. Fick, Jr., 3832 Dance Mill Rd., Phoenix, Md. 21131

[21] Appl. No.: 548,146

[22] Filed: Nov. 1, 1983

[51] Int. Cl.[3] ..... A47B 37/04

[52] U.S. Cl. ..... 108/44; 108/35; 108/131; 248/188.5

[58] Field of Search ..... 108/44, 35, 46, 133, 108/131, 125; 248/188.5, 408

[56] References Cited

U.S. PATENT DOCUMENTS

| | | | |
|---|---|---|---|
| 713,794 | 11/1902 | Ostermann | 248/188.5 |
| 1,891,180 | 12/1932 | Ravlin | 108/46 |
| 1,984,602 | 12/1934 | Snyder | 108/44 X |
| 2,460,712 | 2/1949 | Peterson | 108/131 |
| 2,471,730 | 5/1949 | Dorr . | |
| 2,567,104 | 9/1951 | DiFonzo . | |
| 2,625,454 | 1/1953 | Brown | 108/125 X |
| 2,643,926 | 6/1953 | Pucci | 108/131 |
| 2,721,777 | 10/1955 | Willis . | |
| 2,777,692 | 1/1957 | Marzucco | 248/408 |
| 2,806,723 | 9/1957 | Fairclough | 248/188.5 |
| 2,833,608 | 5/1958 | Tobias . | |
| 2,838,353 | 6/1958 | Emmert | 108/125 X |
| 3,011,847 | 12/1961 | Rader . | |
| 3,164,109 | 1/1965 | Atkinson | 108/44 |
| 3,368,504 | 2/1968 | Cohen | 108/131 |
| 3,566,856 | 3/1971 | Linstead | 108/131 X |
| 3,709,159 | 1/1973 | Oglesby, Jr. . | |
| 3,712,652 | 1/1973 | Uilkema | 248/188.5 X |
| 3,880,091 | 4/1975 | Heinonen | 108/44 |
| 4,089,276 | 5/1978 | Enos | 108/44 |

FOREIGN PATENT DOCUMENTS

| | | | |
|---|---|---|---|
| 933913 | 9/1955 | Fed. Rep. of Germany | 108/44 |
| 834034 | 11/1938 | France | 108/131 |
| 855298 | 1/1939 | France | 108/131 |
| 1073453 | 9/1954 | France | 108/35 |
| 2498133 | 7/1982 | France | 108/44 |
| 250865 | 7/1948 | Switzerland | 108/131 |

*Primary Examiner*—James T. McCall
*Assistant Examiner*—Thomas A. Rendos
*Attorney, Agent, or Firm*—John F. McClellan, Sr.

[57] ABSTRACT

A folding table provides at one end short legs individually height adjustable to rest on the rear of a motor vehicle and at the other end longer legs individually height-adjustable for ground support, constituting a substantially universal fit to automobiles with trunks, and station wagons, with levelling or sloping as desired; in addition, an adjustable sliding brace which steadies the folding table can coact with the shorter legs to clamp the folding table to vehicles; novel, shaped-spring structure is incorporated in leg-positioning provisions and the adjustable brace and the legs are contained within the case-like configuration when the folding table is folded for transport or storage.

2 Claims, 7 Drawing Figures

TABLE FOR USE WITH AUTOMOBILE TRUNKS AND THE LIKE

FIELD OF THE INVENTION

This invention relates generally to portable supporting surfaces and specifically to a folding table with provision for support at one end by a vehicle and at the other end having ground support provision.

BACKGROUND OF THE INVENTION

In the known art various disclosures of devices for the same purpose appear in U.S. Pat. Nos.:

2,471,730 to E. C. Dorr, 5-31-49, shows an automobile trunk folding-table attachment with telescoping legs that fold, and means for detachable attachment to the automobile;

2,567,104 to A. DiFonzo, 9-4-51, shows a complex bumper-attached table for the rear of an automobile;

2,721,777 to J. L. Willis, 10-25-55, shows an automobile table, attachable to a part (bumper) of the automobile with the aid of a jaw (60) and having folding telescoping legs;

2,833,608 to J. C. Tobias, 5-5-58, shows another form of bumper attachable table with folding telescoping legs;

3,011,847 to R. C. Rader, 12-5-61, shows a legless table for auto trunks;

3,709,159 to I. D. Oglesby, Jr., 1-9-73, shows another form of auto trunk table with telescoping folding legs and means for engaging the trunk edge.

SUMMARY OF THE INVENTION

In contrast with the known art, it is a principal object of this invention to provide a table, of the type described but that can be levelled or sloped in any direction desired and raised and lowered and shifted laterally and fore-and-aft, relative an auto supporting one end of it, all with simple and sturdy mechanism and without need for special installation or modification.

Further objects are to provide a table as described that can be used with most if not all auto trunks, and hatchback and station wagon cargo supporting surfaces, with no modification.

Still further objects are to provide a table as described which can be braced using an integral brace assembly, which folds and stows away conveniently and compactly, which is lightweight, durable, attractive and economical, and is well adapated for use at sporting events, picnics and the like.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
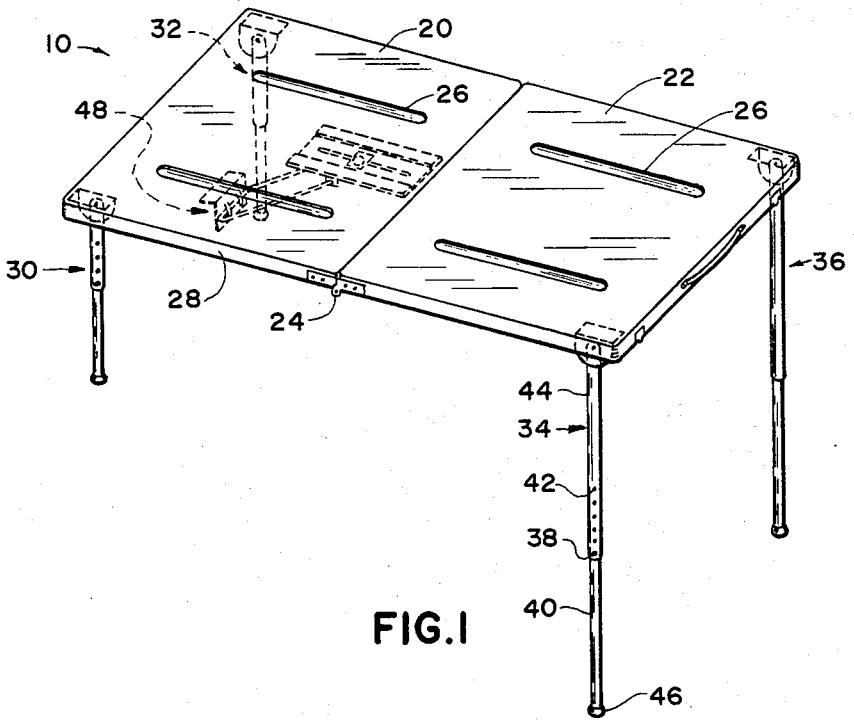
FIG. 1 is a perspective view of the invention.

FIG. 1 shows embodiment 10 of the folding table of this invention, in use-position.

Top panels 20, 22 have on each side a hinge, 24 shown. When opened, the top panels abut along one edge as shown, forming a substantially planar working surface, which may have stiffening bends 26. A supporting system is provided for the folding table as follows. The panel edges are downturned all around as a frame 28 that mounts the hinges. At each of the opposed, distal edges there is a pair of pivotally secured legs, one at each corner. The first pair of legs 30, 32 is designed to rest on the cargo area floor of a motor vehicle and for this is shorter than the second pair of legs 34, 36, which is used for ground support. These two sets of legs comprise means adapting the folding table for levelling, or for sloping in any desired direction as to direct runoff.

Each leg has an independent length-adjustment a conventional telescoping provision, comprising a plunger 38 affixed to the inner tube 40 and protruding through a hole in it into a selected hole of a series of holes 42 in the outer tube 44. Each leg has a rubber tip 46.

A brace assembly 48 mounted centrally beneath table panel 20 is shown in a use-position, as will be described below.

Figure 2:
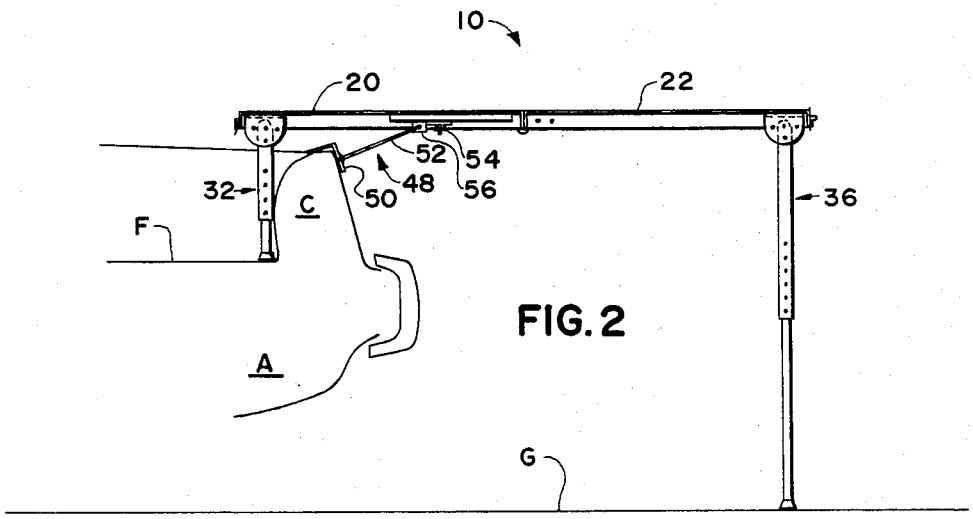
FIG. 2 is a side elevational view of the invention, partly in section, diagramming the relationship between the invention and a motor vehicle supporting one end of the invention.

FIG. 2 shows the invention 10 in use with an automobile A. The first pair of legs (32 shown) rests on the cargo area floor F, the panels 20, 22 span over the rear coaming structure C of the automobile and are supported in level attitude from the ground G by the second pair of legs (36 shown).

The proportions of the legs are made such that table height in the range of 30 to 40 inches (75 cm to 100 cm) can be maintained on uneven ground over which vehicles can pass.

Table area unfolded may be 20 to 44 inches (50 by 110 cm) but the overall design is versatile and can be embodied in larger or smaller versions. Folded dimensions may be 20 by 22 by 3 inches (50 by 56 by 7.5 cm).

Brace assembly 48 may be used to hold the folding table more securely by clamping against the coaming structure C, if desired, with the first pair of legs 30, 32, acting as a jaw of the clamp. As will be seen in more detail later, the brace holds against the automobile an angle 50 of plastic or plastic-surfaced metal, pivoted to the underside of the table by arm 52 that is slidably adjusted by a wingnut 54 clamping a sliding plate 56.

Figure 3:
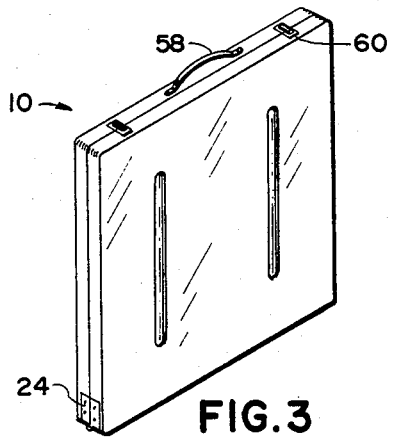
FIG. 3 is a perspective view of the invention folded for transportation or storage.

FIG. 3 shows the invention 10 ready for carriage by handle 58, compactly folded about hinge 24, with the halves secured together by ordinary suitcase hasps 60 or the like.

Figure 4:
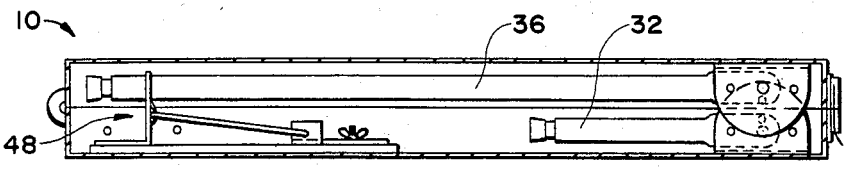
FIG. 4 is a side elevational partly sectional view of the invention folded.

FIG. 4 shows the interior of the invention 10 when folded, including the legs 32 and 36 and between the short pair of legs the brace assembly 48.

Figure 5:
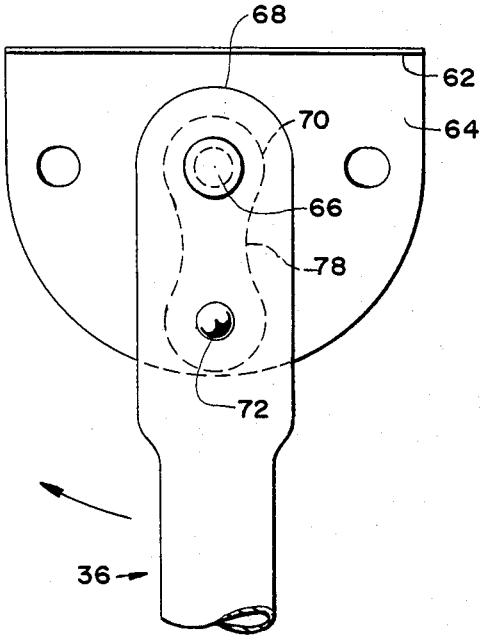
FIG. 5 is a side elevational detail showing typical leg attachment.
Figure 6:
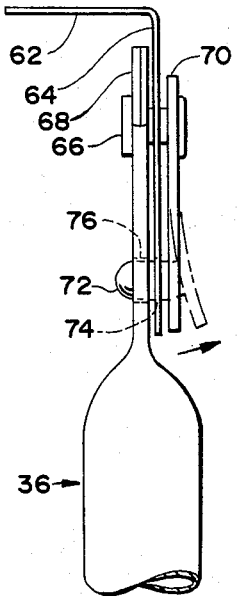
FIG. 6 is an end elevational view showing leg attachment.

FIGS. 5 and 6 detail pivotal attachment and adjustment of a typical leg 36. An angle-shaped bracket with the base leg 62 secured to a panel underside, has a downward vertical leg 64 to which a rivet 66 pivots the flattened end 68 of the leg by being fixed through suitable holes in both.

To fix the leg releasably in load supporting position perpendicular to the table surface, a flat spring 70 is also held by rivet 66 and has a distal end with a protrusion 72 or plunger fixed on it and extending through aligned hole 74 in the bracket and hole 76 in the table leg. Flexing the spring to the position shown in broken lines releases the leg by withdrawal of the protrusion 72 from it. The flat spring preferably has hourglass shape or reduced-waist 78, providing width at the ends for holding but reducing the force necessary to flex the spring. The parts are shown spaced for exposition.

Figure 7:
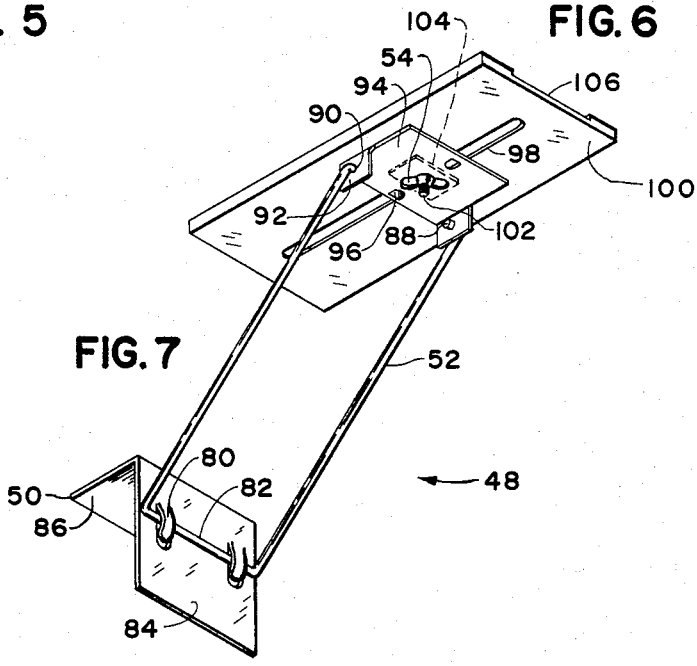
FIG. 7 is a perspective view of a stay bracket.

FIG. 7 details the brace assembly 48. Angle 50 has two lanced-out tabs 80 bent over the free end 82 of squared "U"-shaped arm 52 to hold that end to the upright leg 84 of the angle, the horizontal leg 86 of which extends forwardly.

The fixed ends 88 of the arm 52 are inturned for pivotal securance in aligned holes 90 in the downward ears 92 of a horizontal plate 94. The plate 94 has lanced-out aligned anti-rotation table 96 extending into slot 98 in guideway 100 along which plate 94 slides adjustably, to any desired position, at which tightening the wing nut 54 will fix it. The guideway is fixed to the underside of the table top. Tightening wing nut 54 draws together plate 9 and guideway 100 by means of screw 102 which has a rectangular head 104 that fits and slides along recess 106 in the upper side of the guideway 100.

Material for the embodiment described may be any suitable thermoplastic such as polystyrene or ABS, or may be aluminum. The legs and brace assembly may best be of aluminum.

It will be apparent that the leg adjustments can level or slope the invention in any direction, as required. Similarly, the feet of the shorter legs can rest on a station wagon bed, or on the tailgate when lowered, or in the joint between tailgate and bed. Because the feet are cushioned they can be slid along any cargo space floor left, right, or fore-and-aft, to adapt to the structure or for convenience in location, without marring, and will support loads without tipping. The invention therefore makes a "universal fit", and without compound telescoping.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a folding table having a supporting system including at a first end, means for support on a motor vehicle and at a second end, a pair of legs with means for independent length-adjustment for ground support substantially at table height, and said motor vehicle being of a type having at the rear a cargo area floor and adjacent structure, the improvement comprising: means adapting said supporting system for levelling said folding table in any desired direction, including said means for support on a motor-vehicle comprising a second pair of legs with independent length-adjustment, said second pair of legs being sufficiently shorter than the first-said pair of legs for resting on a said cargo area floor and positioning said first end substantially at table height, means for bracing against said adjacent structure when the second pair of legs rests on the cargo area floor, said bracing means located for coacting with the second pair of legs for adjustably clamping said adjacent structure, the bracing means including an arm, pivot means slidably affixing a first end of the arm beneath the folding table, and an angle pivotally affixed on a second end of the arm.

2. In a folding table as recited in claim 1, said table comprising first and second rectangular panels, each with downward edges forming a frame therearound, means for hinging said first and second panels to a closed position with the frames together, means for releasibly securing said first and second panels in closed position with said first and second pairs of legs and said bracing means therein, a bracket pivot securing said first and second pairs of legs adjacent the frame means for releasably holding each leg in position for supporting said folding table, including a flat spring secured at each said bracket pivot and a protrusion on said flat spring extending through a respective hole in said bracket pivot and detachably engaging a hole in a said leg, and said flat spring having an hourglass shape.

* * * * *